US008947256B2

(12) United States Patent
Xin et al.

(10) Patent No.: US 8,947,256 B2
(45) Date of Patent: Feb. 3, 2015

(54) MONITORING SYSTEM FOR SUCKER ROD

(75) Inventors: Minchang Xin, Binzhou (CN); Haifeng Zhang, Binzhou (CN); Tian Sang, Binzhou (CN); Weihua Mao, Binzhou (CN); Jialu Tang, Binzhou (CN); Liang Yin, Binzhou (CN); Juguo Zhang, Binzhou (CN); Xinfang Yang, Binzhou (CN)

(73) Assignee: Shandong Nine-Ring Petroleum Machinery Co., Ltd., Binzhou (CN)

( * ) Notice: Subject to any disclaimer, the term of this patent is extended or adjusted under 35 U.S.C. 154(b) by 545 days.

(21) Appl. No.: 13/312,961

(22) Filed: Dec. 6, 2011

(65) Prior Publication Data

US 2012/0075114 A1 Mar. 29, 2012

Related U.S. Application Data

(63) Continuation of application No. PCT/CN2010/000870, filed on Jun. 17, 2010.

(51) Int. Cl.
*G01V 3/00* (2006.01)
*E21B 43/12* (2006.01)

(52) U.S. Cl.
CPC ..... *E21B 43/127* (2013.01)
USPC ..... 340/854.6; 340/856.3; 166/250.01; 73/152.62

(58) Field of Classification Search
CPC ..... H01L 2224/16225; H01L 2224/32225; H01L 2224/73204; F04B 47/02; E21B 47/0008
USPC ..... 340/853.1–856.4; 166/53, 66, 166/250.01–255.3; 417/18; 73/152.01–152.62
See application file for complete search history.

(56) References Cited

U.S. PATENT DOCUMENTS

| | | | | |
|---|---|---|---|---|
| 3,859,503 | A * | 1/1975 | Palone | 392/306 |
| 4,509,365 | A * | 4/1985 | Eineichner et al. | 73/152.61 |
| 5,230,607 | A * | 7/1993 | Mann | 417/12 |
| 5,678,981 | A * | 10/1997 | Dunham | 417/18 |
| 6,213,207 | B1 * | 4/2001 | Newman | 166/250.01 |
| 6,253,849 | B1 * | 7/2001 | Newman | 166/255.1 |
| 7,657,468 | B1 * | 2/2010 | Whiteley et al. | 705/28 |
| 7,707,076 | B1 * | 4/2010 | Whiteley et al. | 705/28 |
| 2003/0065447 | A1 * | 4/2003 | Bramlett et al. | 702/6 |
| 2003/0188584 | A1 * | 10/2003 | Newman | 73/700 |
| 2004/0011532 | A1 * | 1/2004 | White | 166/381 |
| 2005/0104176 | A1 * | 5/2005 | Rodney et al. | 257/678 |

(Continued)

FOREIGN PATENT DOCUMENTS

| | | | | |
|---|---|---|---|---|
| WO | WO 93/19296 | A1 * | 9/1993 | F04B 49/06 |
| WO | WO 2006/075337 | A2 * | 7/2007 | |

*Primary Examiner* — Hai Phan
*Assistant Examiner* — Orlando Bousono
(74) *Attorney, Agent, or Firm* — Matthias Scholl P.C.; Matthias Scholl

(57) ABSTRACT

An intelligent monitoring system for a sucker rod including a monitor center, a remote wireless communication equipment communicating with the monitor center and connected with a movement detection and storage equipment of the sucker rod, a radio frequency reader/writer, and a radio frequency storage chip. The movement detection and storage equipment of the sucker rod is connected with the radio frequency reader/writer. The radio frequency storage chip is disposed on the sucker rod to store the information of the sucker rod. The monitoring system can detect and record reciprocating or circumvolving movement of the sucker rod as well as the motion state of the sucker rod in an oil well.

11 Claims, 5 Drawing Sheets

(56) References Cited

U.S. PATENT DOCUMENTS

| | | | | |
|---|---|---|---|---|
| 2005/0150691 | A1* | 7/2005 | Schultz et al. | 175/57 |
| 2005/0155759 | A1* | 7/2005 | Bramlett et al. | 166/250.15 |
| 2005/0158179 | A1* | 7/2005 | Medizade et al. | 417/53 |
| 2006/0171821 | A1* | 8/2006 | Brown | 417/390 |
| 2006/0196657 | A1* | 9/2006 | Wollmann | 166/241.4 |
| 2008/0035325 | A1* | 2/2008 | Ali-zada et al. | 166/68.5 |
| 2009/0283259 | A1* | 11/2009 | Poitzsch et al. | 166/250.01 |
| 2009/0285051 | A1* | 11/2009 | Poitzsch et al. | 367/19 |
| 2009/0311107 | A1* | 12/2009 | Chavez Zapata | 417/12 |
| 2010/0332036 | A1* | 12/2010 | Medizade et al. | 700/282 |

* cited by examiner

MONITORING SYSTEM FOR SUCKER ROD

CROSS-REFERENCE TO RELATED APPLICATIONS

This application is a continuation of International Patent Application No. PCT/CN2010/000870 with an international filing date of Jun. 17, 2010, designating the United States, now pending. The contents of all of the aforementioned applications, including any intervening amendments thereto, are incorporated herein by reference.

BACKGROUND OF THE INVENTION

1. Field of the Invention

The invention relates to oil producing equipment, and more particularly to an intelligent monitoring system for a sucker rod.

2. Description of the Related Art

Conventional methods for extracting oil mainly depend on the lifting by means of mechanical movement. As an important part of mechanical equipment for oil extraction, a sucker rod passes the ground drive and motion state thereof to an underground oil pump. The sucker rod can transfer both reciprocating movement load of axial direction and circumvolving movement load.

In an oil extraction system using a tube oil pump, the sucker rod moves in a to and fro mode. When the movement exceeds a certain circle number, the suck rod easily suffers fatigue fracture. Thus, the oil extraction system collapses. In an oil extraction system using a screw pump, the sucker rod moves in a whirligig mode and passes torsion load. When the movement exceeds a certain circle number, the suck rod also suffers fatigue fracture. Thus, the oil extraction system collapses. When one sucker rod is replaced, due to absence of test equipment, old and new sucker rods are usually employed at the same time, and then some overused sucker rods suffer fatigue fracture because of overloading. The oil output may be greatly decreased and the maintenance cost for the system is very high.

SUMMARY OF THE INVENTION

In view of the above-described problems, it is one objective of the invention to provide an intelligent monitoring system for a sucker rod. The monitoring system can detect and record the number of the reciprocating or circumvolving movement and monitor the motion state or current load of the sucker rod.

To achieve the above objective, in accordance with one embodiment of the invention, there is provided an intelligent monitoring system for a sucker rod comprising:

a) a monitor center;

b) a remote wireless communication equipment;

c) a movement detection and storage equipment of the sucker rod;

d) a radio frequency (RF) reader/writer; and e) a RF storage chip;

wherein the remote wireless communication equipment communicates with the monitor center and connects with the movement detection and storage equipment of the sucker rod; the movement detection and storage equipment of the sucker rod connects with the RF reader/writer; the RF storage chip is disposed on the sucker rod to store the information of the sucker rod;

the RF reader/writer reads or writes the parameter of the sucker rod from the RF storage chip; the movement detection and storage equipment of the sucker rod detects and stores the motion state of the sucker rod, the motion state comprising the number of reciprocating or circumvolving movement and the load of the sucker rod; the remote wireless communication equipment sends the information stored in the movement detection and storage equipment of the sucker rod to the monitor center so that the monitor center obtains the work state of an oil well and the sucker rod therein; the monitor center feedbacks the motion state of the sucker rod and alerts the abnormal state of the oil well; and the movement detection and storage equipment of the sucker rod comprises a main microprocessor and elements connected therewith, the elements comprising a watchdog circuit, a signal conditioning circuit, a flash memory, and a USB interface circuit; the signal conditioning circuit is further connected with a current transformer; and the main microprocessor is connected with the remote wireless communication equipment.

In a class of this embodiment, the RF storage chip stores information such as the raw material, manufacturer, manufacturing date, ID number, and the number of reciprocating or circumvolving movement of the sucker rod. One end surface of the sucker rod comprises a groove in which the RF storage chip is embedded. Optionally, a chip box is disposed in the sucker rod for receiving the RF storage chip. The chip box is connected to the head of the sucker rod using a screw. The RF storage chip can also be put in a joint hoop connecting two sucker rods. When used in down hole, according to demand, a plurality of sucker rods embedded with the RF storage chips can be connected in turn to constitute a sucker rod pole.

In a class of this embodiment, the RF reader/writer comprises a second microprocessor and elements connected therewith, the elements comprising a RF transceiver module, a keyboard, an LCD, a voice output module, and a buzzer. The RF transceiver module is further connected with an antenna.

In a class of this embodiment, the RF storage chip comprises a RF front end module having an antenna, an LC resonator connected with the RF front end module. The LC resonator is connected with a digital storage module via a modem. The digital storage module is further connected with a timer module.

In a class of this embodiment, the remote wireless communication equipment is a GSM communication module, GPRS communication module, or 3G communication module. The main microprocessor is PIC18F6620. The second microprocessor is LPC2138. The flash memory is AT45DB081B. The LCD is a display module. The RF transceiver module employs a CLRC632 chip.

Prior to the package of the sucker rod, such primary information as the raw materials, manufacturer, the manufacturing date, and the ID number of the sucker rod have been written into the RF storage chip. Thus, a private ID is established for the sucker rod. When the sucker rod is used underground, such information as the oil well site, the sequence number of the oil well, the time, and the downhole number of the sucker rod is written into the RF storage chip using the RF reader/writer. The movement detection and storage equipment of the sucker rod stores the motion state of the sucker rod, for example, the number of reciprocating or circumvolving movement. When rising up from the oil well, the RF reader/writer writes the movement number of the sucker rod into the RF storage chip. Thus, the movement number of the sucker rod is recorded. As needed, the forecasting remaining life of the sucker rod can also be written into the RF storage chip according to the usage state thereof. At the same time, the ID number of the newly-replaced sucker rod which will be used downhole should be stored in the movement detection and storage equipment of the sucker rod so as to monitor the newly-replaced sucker rod. There is an interface between the movement detection and storage equipment of the sucker rod and the remote wireless communication equipment. They are connected using a serial port. The information stored in the movement detection and storage equipment of the sucker rod is send to the monitor center via the remote wireless communication equipment. When abnormal failure occurs, alert information is sent to the monitor center.

In this system, a power supply system of a pumping unit on the ground provides the power for the movement detection and storage equipment of the sucker rod and the remote wireless communication equipment. When the power supply system breaks off, lithium batteries or capacitors are used to provide power. The motion state information of the sucker rod before power failure is stored in the movement detection and storage equipment of the sucker rod. The information of the power failure is then sent to the monitor center for alerting. The RF reader/writer is powered by lithium batteries, and when the power is insufficient, the power supply system of the pumping unit on the ground is also available.

Advantages of the invention are summarized below. As an independent electronic account number is established, the intelligent monitoring and management of the sucker rod can be achieved with the cooperation of the monitoring system. The sucker rod and the monitoring system thereof can be used at oil fields in a plain land, in desert, or on the sea. In addition, the usage state of the sucker rod that is transported to a warehouse can be checked through reading the RF reader/writer. The sucker rod are classified and placed according to the usage number thereof. The sucker rods having similar usage number can be used in coordination, which effectively avoids the problem of the mix use of the sucker rods having different service life and achieves intelligent management of the sucker rods. Thus, such benefits as the reduction of accidents, the reduction of maintenance costs, and remarkable efficiency improvement are realized.

Figure 1:
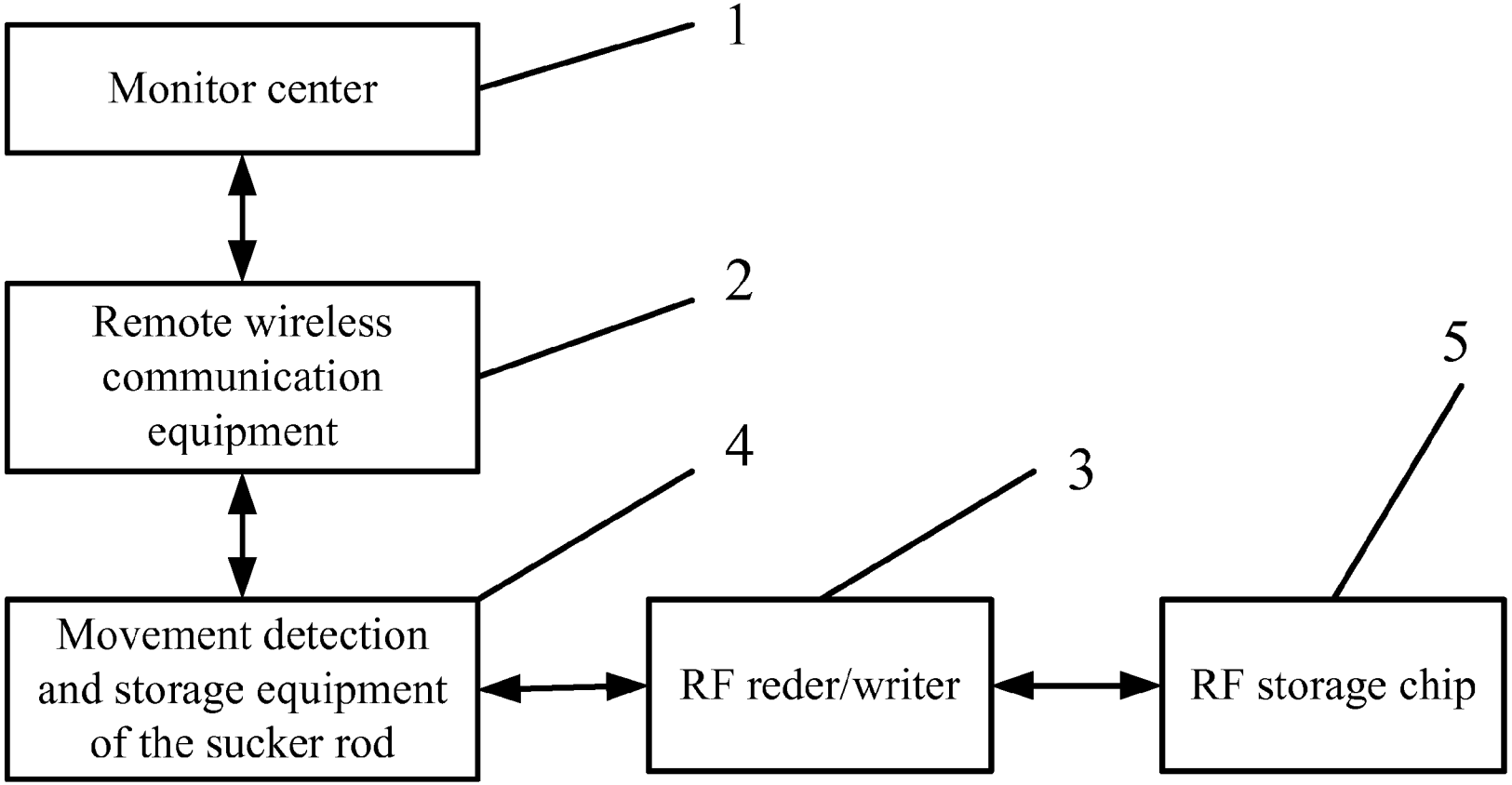
FIG. 1 is a schematic diagram of an intelligent monitoring system for a sucker rod according to one embodiment of the invention.

In the drawings, the following reference numbers are used: 1. Monitor center; 2. Remote wireless communication equipment; 3. RF reader/writer; 4. Movement detection and storage equipment of the sucker rod; 5. RF storage chip; 6. Voice output module; 7. Buzzer; 8. RF transceiver module; 9. Antenna; 10. Second microprocessor; 11. First RS232 serial port; 12. Keyboard; 13. LCD; 14. USB interface circuit; 15. Watchdog circuit; 16. Flash memory; 17. Current transformer; 18. Signal conditioning circuit; 19. Main microprocessor; 20. Second RS232 serial port; 21. Third RS232 serial port; 22. Antenna of RF memory chip; 23. RF front end module; 24. LC resonator; 25. Modem module; 26. Digital storage module; 27. Timer module; 28. Sucker rod; 29. Joint hoop.

DETAILED DESCRIPTION OF THE EMBODIMENTS

For further illustrating the invention, experiments detailing an intelligent monitoring system for a sucker rod are described below. It should be noted that the following examples are intended to describe and not to limit the invention.

Figure 2:
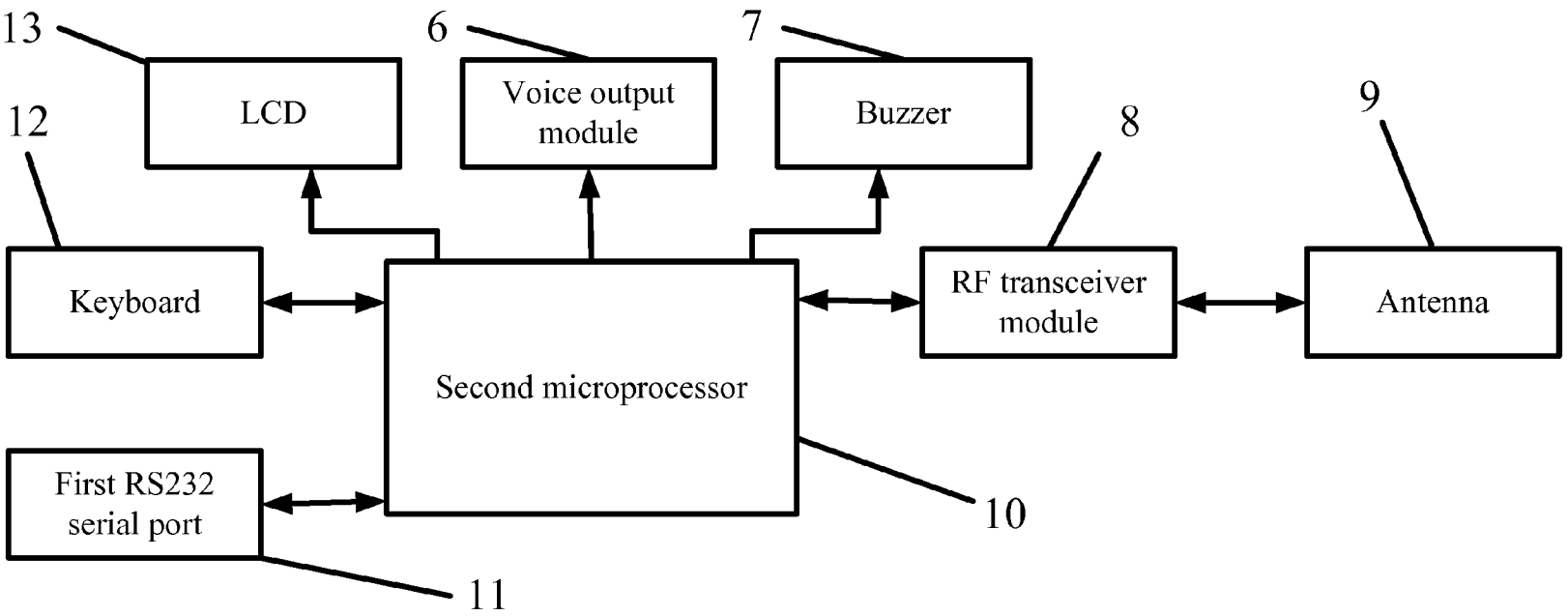
FIG. 2 is a schematic diagram of a RF reader/writer according to one embodiment of the invention.
Figure 3:
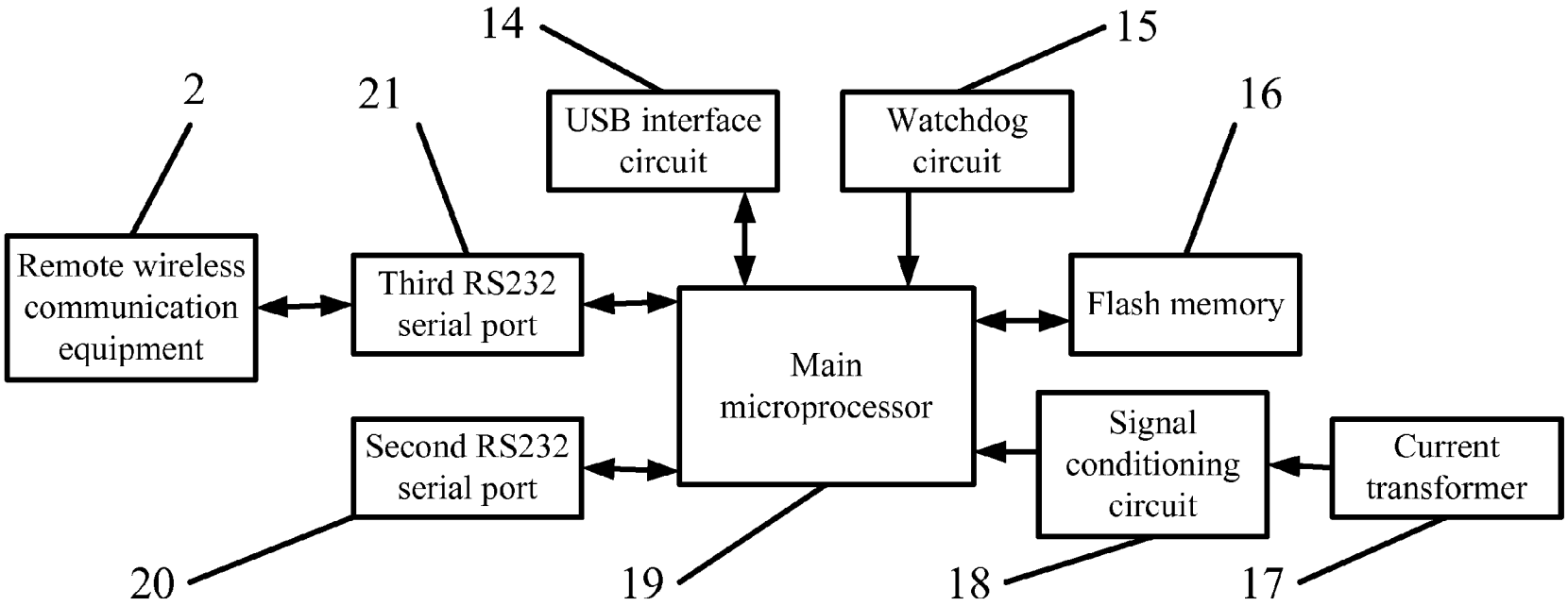
FIG. 3 is a schematic diagram of a movement detection and storage equipment of the sucker rod according to one embodiment of the invention.
Figure 4:
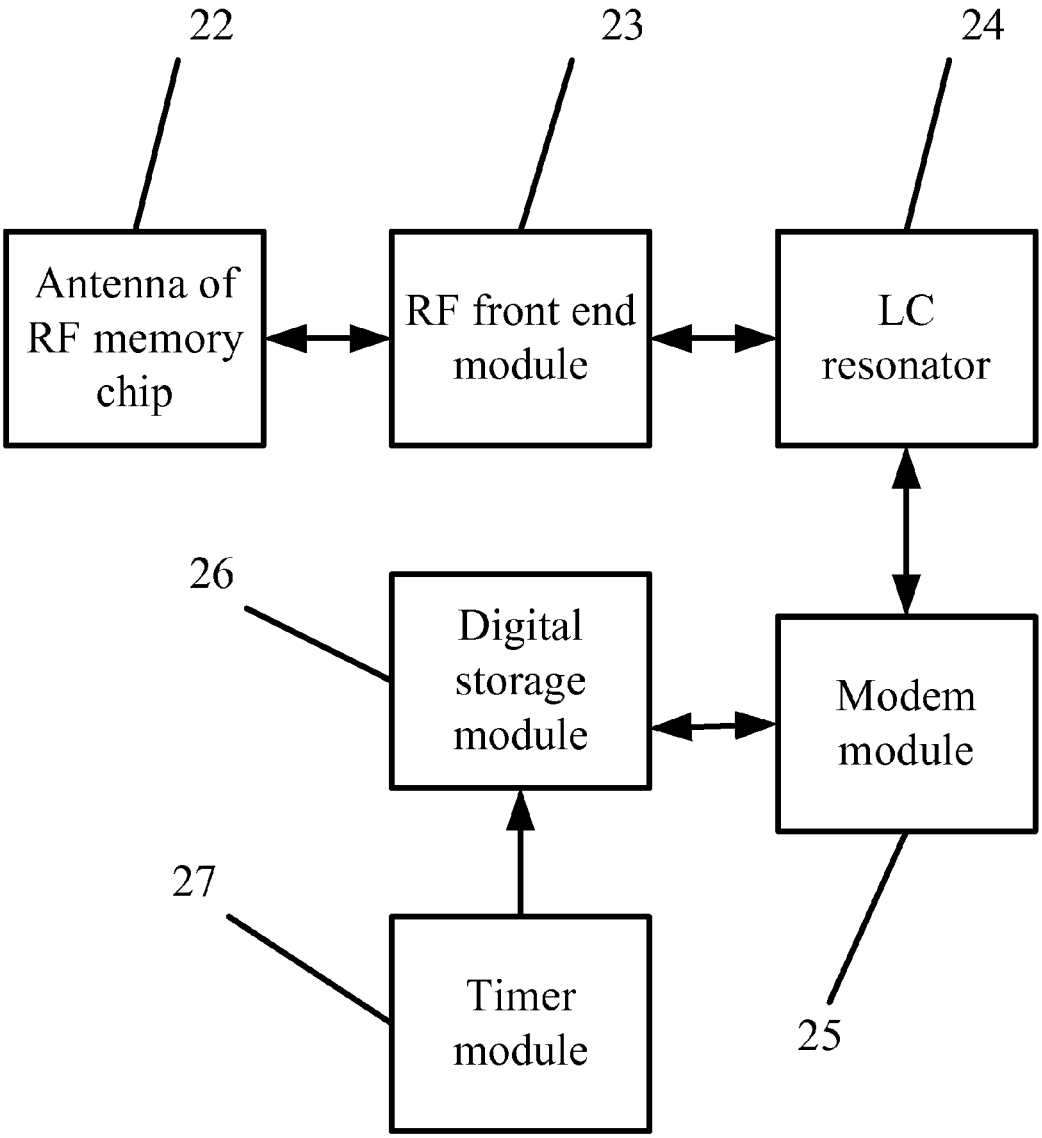
FIG. 4 is a schematic diagram of a RF memory chip according to one embodiment of the invention.
Figure 5:
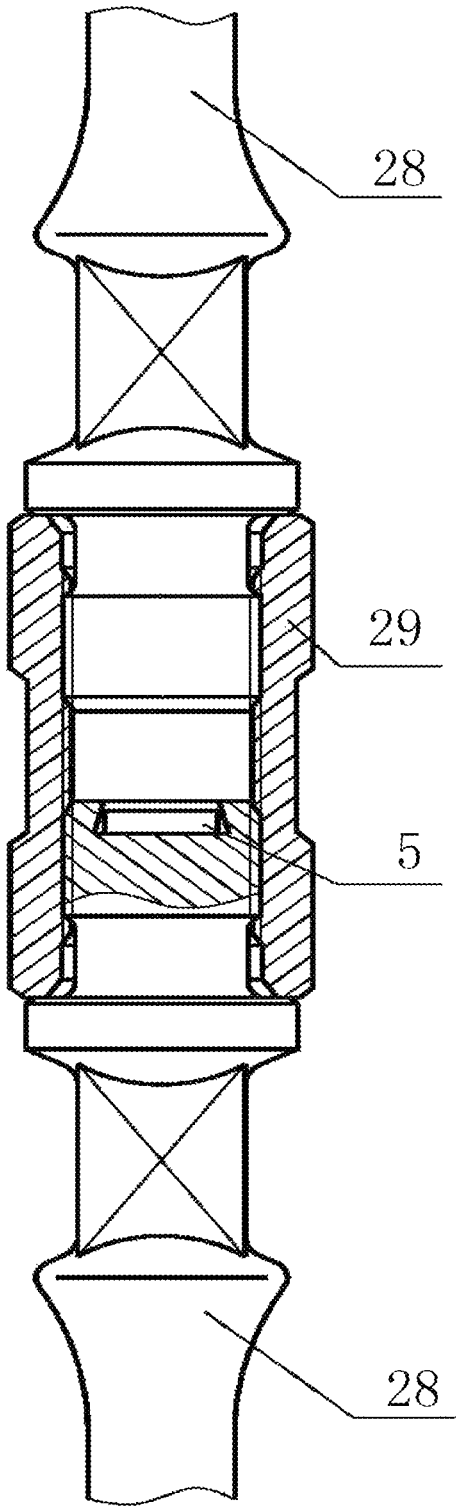
FIG. 5 is a schematic diagram of the connection of sucker rods according to one embodiment of the invention.

As shown in FIGS. 1-5, an intelligent monitoring system for a sucker rod comprises a monitor center 1 and a remote wireless communication equipment 2 which communicates with the monitor center 1. The remote wireless communication equipment 2 is connected to a movement detection and storage equipment of the sucker rod 4. The movement detection and storage equipment of the sucker rod 4 is connected with a RF reader/writer equipment 3. In addition, a RF storage chip 5 is embedded in the sucker rod 28 to store information of the sucker rod 28.

In this embodiment, the RF memory chip 5 is embedded in a groove disposed at an end surface of the sucker rod 28 which is connected using a joint hoop 29. The RF reader/writer 3 reads and writes the parameter of the sucker rod 28 by reading or writing the RF memory chip 5. The movement detection and storage equipment of the sucker rod 4 stores the record of the number of reciprocating and circumvolving movement and load data of the sucker rod 28. The information stored in the movement detection and storage equipment of the sucker rod 4 is send to the monitor center 1 via the remote wireless communications equipment 2. Thus, the monitor center 1 collects the real-time work state of the oil well and the sucker rod. The monitor center 1 monitors the motion state of the sucker rod 28 and alerts the abnormal state of the oil well.

The RF reader/writer 3 comprises a second microprocessor 10, a RF transceiver module 8, a keyboard 12, an LCD 13, a voice output module 6, a buzzer 7, and a first RS232 serial port 11, all of which connected with the second microprocessor 10. The RF transceiver module 8 is also connected with an antenna 9. Chip CLRC632 is used in the RF transceiver module 8. The second microprocessor 10 is LPC2138 and connected to the LCD 13, voice output module 6, buzzer 7, and keyboard 12 via an I/O port. The read, write, and confirmation of the RF memory chip 5 are achieved using the keyboard 12. The D/A output pin of the second microprocessor 10 outputs voice. The voice is amplified by a power amplifier and then sent into headphones or speakers which suggest the success or failure of reading/writing and operation. When the reading/writing is successful, the buzzer 7 produces beeps, and a voice is produced to suggest success. The RF reader/writer 3 can work in either HF band or UHF band.

The RF storage device 5 comprises a RF front-end module 23 with an antenna 22 and an LC resonator 24 connected with the RF front-end module 23. The LC resonator 24 is connected to a digital storage module 26 via a modem module 25. The digital storage module 26 is further connected with a timer module 27.

The main parameters of the sucker rod 28 are written into the RF storage chip 5 prior to the package of the sucker rod 28. When the sucker rod 28 is put into an oil well, the ID number thereof is recorded by the movement detection and storage equipment of the sucker rod 4. When the sucker rod is working, the movement number thereof is recorded in a flash memory 16 disposed inside the movement detection and storage equipment of the sucker rod 4. The movement detection and storage equipment of the sucker rod 4 recording the movement number of the sucker rod comprises a main microprocessor 19 and elements connected therewith, the elements comprising a watchdog circuit 15, the flash memory 16, a USB interface circuit 14, a current transformer 17, a signal conditioning circuit 18, a second RS232 serial port 20, and a third RS232 serial port 21. The type of the first microprocessor 19 is PIC18F6620. The type of the watchdog circuit 15 is chip 25043 with functions of preventing the program from running away or falling into an infinite loop. The type of the flash memory is AT45DB081B whose main function is to store needed information when the power breaks off, such as ID number of the sucker rod 28 and the current movement number of the sucker rod 28. The type of the USB interface circuit 14 is USB controller CH375B connected with the main microprocessor 19. The data in the movement detection and storage equipment of the sucker rod can be written into a USB disk. Thus, the movement number of the sucker rod 28 can be stored in the USB disk, and technicians can get the on-site data of the oil well therefrom. The data will be taken back to the monitor center 1 for updating the information of the sucker rod. The current transformer 17 detects the movement number of the sucker rod 28. An output of the current transformer 17 is connected to an input end of the signal conditioning circuit 18. The output end of the signal conditioning circuit 18 is connected to an A/D converter of the main microprocessor. The current transformer 17 measures a one-phase current value of a three phase power supply. The current value is transmitted to an A/D converter port of the main microprocessor via the signal conditioning circuit 18. Thus, the movement number of the sucker rod 28 is collected. If a reciprocating oil pump is used, the measurement of the movement number of the sucker rod 28 is achieved by measuring the maximum current value in one cycle. If a screw oil pump is used, the measurement of the movement number of the sucker rod 28 is achieved by measuring the frequency of a motor.

In this embodiment, a GSM communication module is used in the remote wireless communications equipment 2. The GSM communication module is connected to the movement detection and storage equipment of the sucker rod 4 via the second RS232 serial port 20. The movement detection and storage equipment of the sucker rod 4 is connected to the first RS232 serial port 11 of the RF reader/writer 3 via the third RS232 serial port 21. When rising up from the well, the movement number of the sucker rod 28 stored in the movement detection and storage equipment of the sucker rod 4 is written into the RF storage chip 5 of the sucker rod 28. Thus, the movement number of the sucker rod 28 is collected. At the same time, the RF reader/writer 3 reads the ID number of a newly-introduced sucker rod 28 and then writes the ID number into the movement detection and storage equipment of the sucker rod 4 for inquiry of the data of the sucker rod 28.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A monitoring system for a sucker rod, comprising:

a) a monitor center;

b) a remote wireless communication equipment;

c) a movement detection and storage equipment of the sucker rod;

d) a radio frequency reader/writer; and e) a radio frequency storage chip;

wherein the remote wireless communication equipment communicates with the monitor center and connects with the movement detection and storage equipment of the sucker rod; the movement detection and storage equipment of the sucker rod connects with the radio frequency reader/writer; the radio frequency storage chip is disposed on the sucker rod to store information of the sucker rod;

the radio frequency reader/writer reads or writes the information of the sucker rod from the radio frequency storage chip; the movement detection and storage equipment of the sucker rod detects and stores a motion state of the sucker rod, the motion state comprising a number of reciprocating or circumvolving movements and a load of the sucker rod; the remote wireless communication equipment sends the motion state stored in the movement detection and storage equipment of the sucker rod to the monitor center so that the monitor center obtains a work state of an oil well and the sucker rod therein; the monitor center feedbacks the work state of the oil well and the sucker rod therein and alerts an abnormal state of the oil well; and the movement detection and storage equipment of the sucker rod comprises a first main microprocessor and elements connected therewith, the elements connected to the first main microprocessor comprising a watchdog circuit, a signal conditioning circuit, a flash memory, and a USB interface circuit; the signal conditioning circuit is further connected with a current transformer; and the first main microprocessor is connected with the remote wireless communication equipment.

2. The monitoring system of claim 1, wherein the radio frequency storage chip comprises a radio frequency front end module having an antenna, an LC resonator connected with the radio frequency front end module; the LC resonator is connected with a digital storage module via a modem; and the digital storage module is further connected with a timer module.

3. The monitoring system of claim 1, wherein the remote wireless communication equipment is a Global System for Mobile (GSM) communication module, General Packet Radio Service (GPRS) communication module, or 3 G communication module.

4. The monitoring system of claim 1, wherein the first main microprocessor is a PIC18F6620 microprocessor.

5. The monitoring system of claim 1, wherein the flash memory is an AT45DB081 B flash memory.

6. The monitoring system of claim 1, wherein a groove is disposed inside an end surface of the sucker rod for receiving the radio frequency storage chip.

7. The monitoring system of claim 1, wherein the radio frequency storage chip is disposed in a joint hoop connecting the sucker rod with at least one other sucker rod.

8. The monitoring system of claim 1, wherein the radio frequency reader/writer comprises a second microprocessor and elements connected therewith, the elements connected to the second microprocessor comprising a radio frequency transceiver module, a keyboard, a display module, a voice output module, and a buzzer; and the radio frequency transceiver module is further connected with an antenna.

9. The monitoring system of claim 8, wherein the second microprocessor is an LPC2138 microprocessor.

10. The monitoring system of claim 8, wherein the display module is a liquid crystal display (LCD).

11. The monitoring system of claim 8, wherein the radio frequency transceiver module comprises a CLRC632 chip.

* * * * *